US005581288A

United States Patent [19]

Shimizu et al.

[11] Patent Number: 5,581,288

[45] Date of Patent: Dec. 3, 1996

[54] INK JET HEAD BLOCK

[75] Inventors: Yukiharu Shimizu; Tsuyoshi Hayakawa; Hiroyuki Kojima; Shoichi Sato; Toshiya Tamura; Takashi Kogo; Hajime Oda, all of Chiba-Ken, Japan

[73] Assignee: Seiko Precision Inc., Tokyo, Japan

[21] Appl. No.: 27,122

[22] Filed: Mar. 5, 1993

[30] Foreign Application Priority Data

Mar. 6, 1992 [JP] Japan ..... 4-049175

[51] Int. Cl.[6] ..... B41J 2/175; B41J 2/045

[52] U.S. Cl. ..... 347/87; 347/71

[58] Field of Search ..... 346/140 R; 347/47, 347/50, 70, 71, 68, 86, 87, 40, 44, 20, 63, 65

[56] References Cited

U.S. PATENT DOCUMENTS

| | | | |
|---|---|---|---|
| 4,521,788 | 6/1985 | Kimura et al. | 347/40 |
| 4,528,575 | 7/1985 | Matsuda et al. | 347/71 |
| 4,677,447 | 6/1987 | Nielsen | 347/87 |
| 4,727,384 | 2/1988 | Tsuda | 347/50 |
| 4,771,295 | 9/1988 | Baker et al. | 347/87 |

FOREIGN PATENT DOCUMENTS

| | | | |
|---|---|---|---|
| 4-292947 | 10/1992 | Japan | 347/40 |

*Primary Examiner*—Alrick Bobb
*Attorney, Agent, or Firm*—Amster, Rothstein & Ebenstien

[57] ABSTRACT

Ink is reserved in a cartridge case. On this cartridge case, there are fixed an ink jet head and an electric connecting member in a stacked state. The ink jet head is constructed to include: ink supply holes adapted to be supplied with the ink from the cartridge case; ink passages communicating with the ink supply holes; nozzles formed in the leading ends of the ink passages; and ink ejecting device such as piezoelectric elements disposed to correspond to the ink passages for ejecting the ink from the nozzles. These nozzles and the ink passages are substantially perpendicular. Moreover, the stacking direction, the ink supply direction from the cartridge case to the ink supply holes, and the ink ejecting direction from the nozzles are made substantially identical. The electric connecting member is made of a flexible frame or a metal lead frame. Thus, the ink jet head is assembled merely by stacking those individual components in the common direction.

4 Claims, 4 Drawing Sheets

INK JET HEAD BLOCK

BACKGROUND OF THE INVENTION

1. Field of the Invention

The present invention relates to an ink jet head block of the so-called "on-demand type" for printing by ejecting ink droplets from nozzles.

2. Description of the Prior Art

The ink jet head of the on-demand type of the prior art is exemplified in Japanese Patent Laid-Open 14261/1980 (i.e., Prior Art 1) and Japanese Patent Publication No. 4309/1984 (i.e., Prior Art 2) by a structure, in which ink passages are arranged generally in parallel at the end face of the nozzle to have their one-side ends arrayed at the central portion and are individually equipped at their individual end portions at the central portion with nozzles extending through a passage substrate so that ink droplets may fly perpendicularly of the ink passages.

In the Prior Art 1, all the ink passages have their outer circumferential end portions communicating with a common ink chamber so as to supply the ink to the ink passages, and the ink supply holes are projected outward from a portion of the common ink chamber. However, there is no disclosure on the structure for supplying the ink to the ink supply holes and the means for supplying an electric power to the piezoelectric elements in a pressure chamber disposed in the ink passages.

In the Prior Art 2, the ink passages are formed separately in a plurality of layers to densify the nozzles highly. The ink supply passages are projected backward, but there is no disclosure on the structure for supplying the ink to the ink supply passages and the means for pressurizing and ejecting the ink in the ink supply passages.

In the Prior Art 1, the ink supply holes are projected outward. In order to supply these ink supply holes with the ink, the common ink chamber has to be arranged outside of the ink supply holes so that the space is two-dimensionally enlarged. In addition, the assembly cannot be made merely by stacking so that it is not suitable for automation.

In the Prior Art 2, the individual ink supply passages are projected backward and have to be supplied with the ink. As a result, the space is enlarged not in the two-dimensional directions but in the thickness direction. Moreover, the ink supply passages require means for communicating with the ink tank so that the structure is complicated. Like the aforementioned example, the assembly cannot be made merely by the stacking so that it is not suitable for automation.

SUMMARY OF THE INVENTION

It is, therefore, an object of the present invention is to make it possible by reducing the space both in the two-dimensional direction and in the thickness direction to improve the assembly and to supply the ink from the cartridge case to the ink jet head at the shortest distance and without any leakage.

In order to achieve the above-specified object, in an ink jet head block according to the present invention, a cartridge case for reserving ink and an ink jet head are fixed in a stacked state. The ink jet head is equipped with: ink supply holes adapted to be supplied with the ink from the cartridge case; ink passages communicating with the ink supply holes; nozzles formed at the leading ends of the ink passages; and ink ejecting means provided to correspond to the ink passages for ejecting the ink from the nozzles. The nozzles and the ink passages are formed to intersect substantially perpendicularly. Moreover, the stacking direction, the direction to supply the ink from the cartridge case to the ink supply ports, and the direction to eject the ink from the nozzles are substantially identical.

If, moreover, an electric connecting member for supplying an electric power to the aforementioned ink ejecting means is fixed in a stacked state with respect to the ink jet head, this structure is better effective for improving the assembly.

The electric connecting member to be used is made of a flexible cable or a metal lead frame.

An elastic member for establishing and sealing the communication between the ink hole of the cartridge case and the ink supply holes of the ink jet head is also provided for preventing the ink leakage. This elastic member is integrally formed with pressure portions for pressing the electric connecting member onto the ink ejecting means thereby to ensure the electric connection.

On the nozzle face of the ink jet head, there may be mounted a supporting plate which has holes facing the nozzles.

DESCRIPTION OF THE PREFERRED EMBODIMENTS

Figure 1:
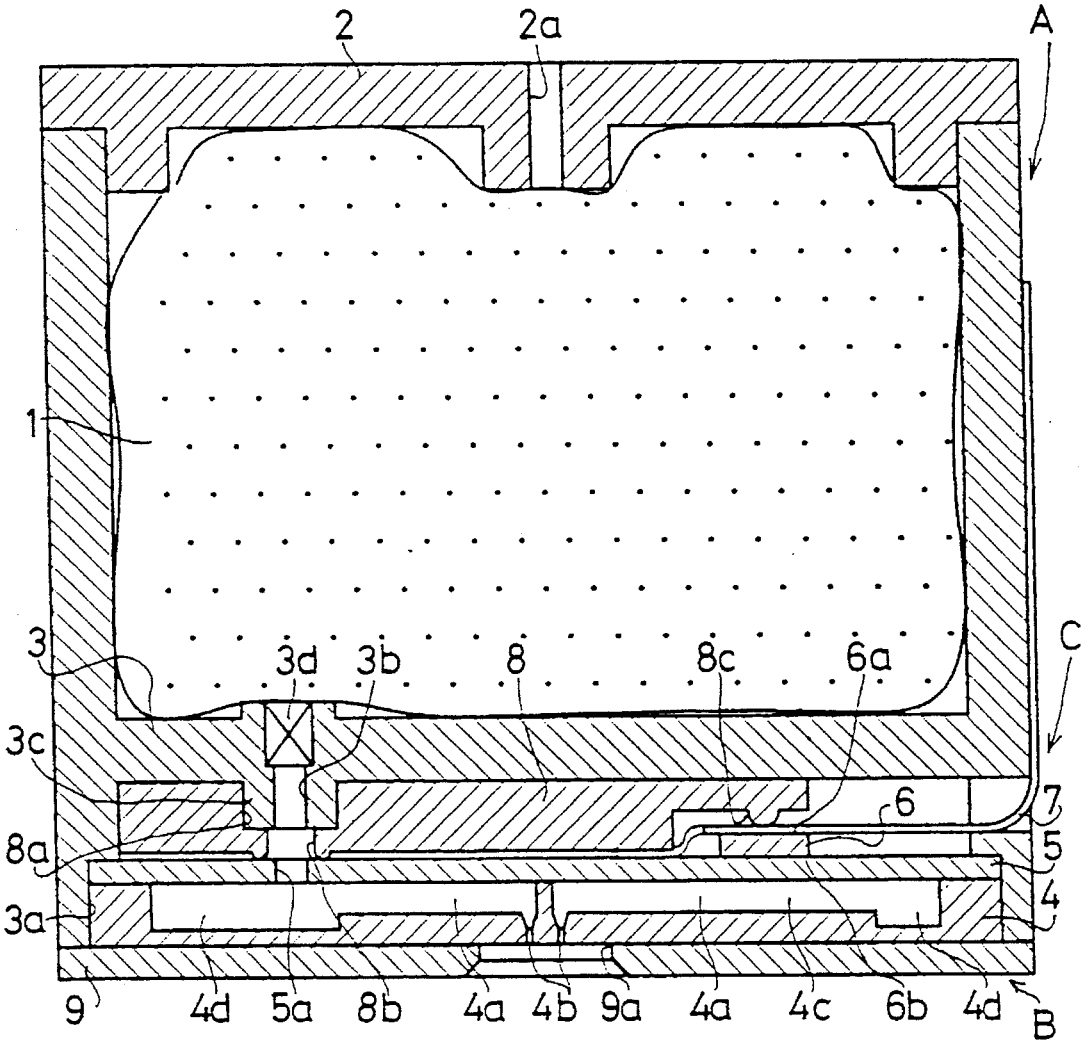
FIG. 1 is a section showing one embodiment of the present invention.

As shown in FIG. 1, an upper cartridge case A and a lower ink jet head B are fixed in a stacked state.

Figure 4:
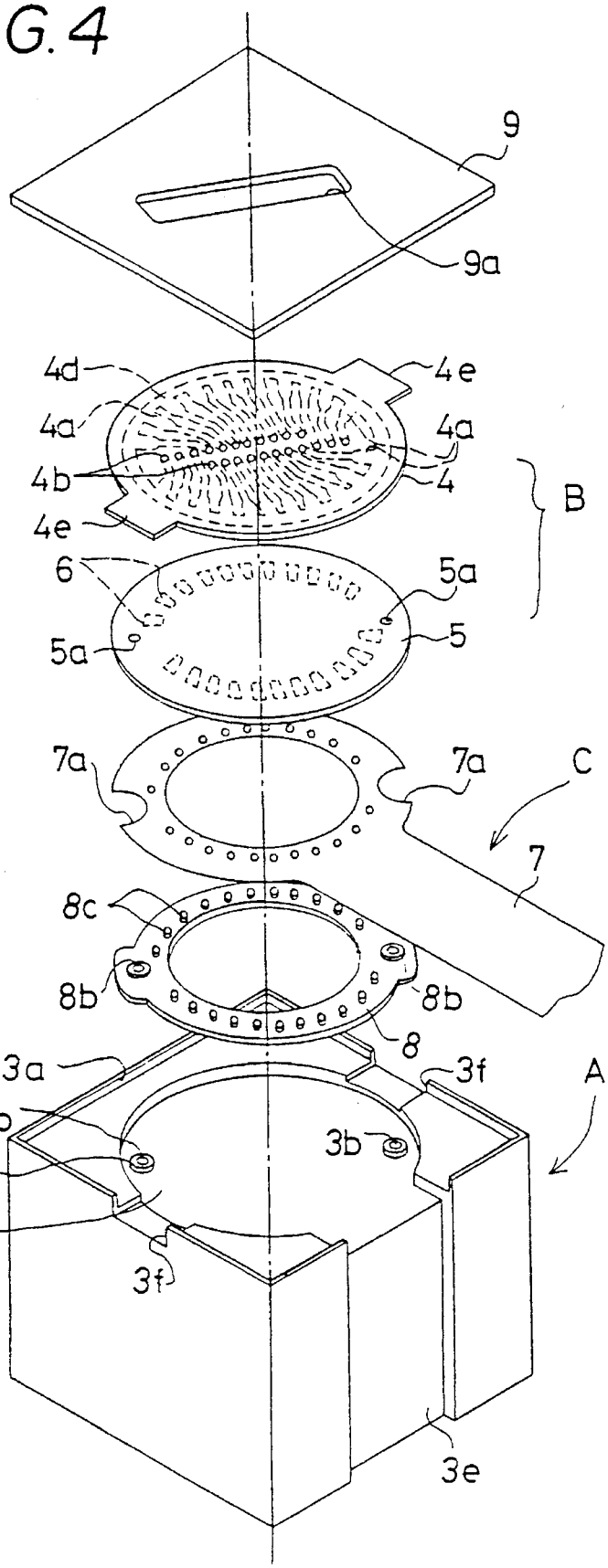
FIG. 4 is an exploded perspective view showing the embodiment of the present invention.

The cartridge case A is constructed, as shown in FIGS. 1 and 4, by housing a sponge impregnated with ink 1 and by sealing it by a cover 2. This cover 2 is formed with an air vent hole 2*a*. The cartridge case A is equipped outside of its wall 3 opposed to the cover 2 with a head housing portion 3*a*. The wall 3 is formed with an ink hole 3*b* for providing the communication with the inside of the cartridge case A and the head housing portion 3*a*. The wall 3 is further formed with a pipe 3*c* which is directed toward the head housing portion 3*a* for communicating with the ink hole 3*b*. In the ink hole 3*b*, there is fitted a filter 3*d* for filtering dust or the like in the ink to prevent it from stealing into the ink jet head B. The cartridge case A, as shown in FIG. 4, is formed partially in its outer circumference with a recess 3*e* for housing the leads of an electric connecting member C. The cartridge case A is further formed with recesses 3*f* and 3*f* for positioning members to be housed in the head housing portion 3*a*.

Figure 2:
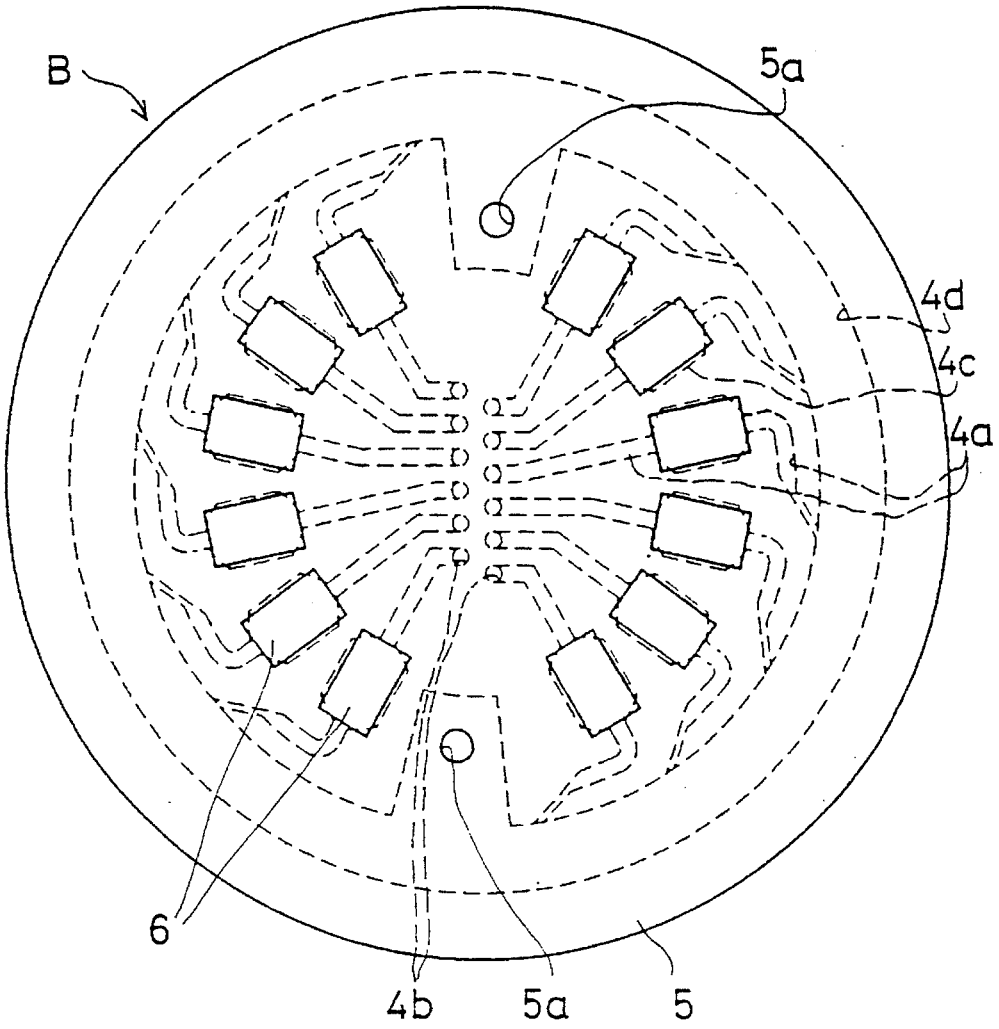
FIG. 2 is a back elevation showing an ink jet head.
Figure 3:
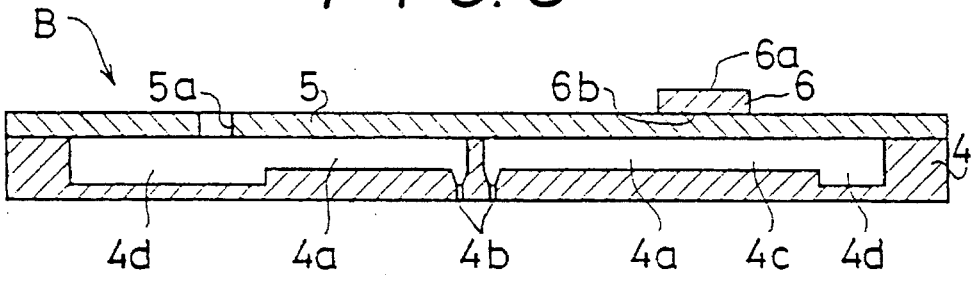
FIG. 3 is a section showing an essential portion of the ink jet head.

The ink jet head B is exemplified in FIGS. 1 to 4. The example shown in FIGS. 1 to 3 is a head having twelve nozzles, and the example shown in FIG. 4 is a head having twenty two nozzles. These heads have substantially identical constructions although their contours and passage shapes are slightly different. A passage substrate 4 having ink passages 4*a* and so on is formed either by a plastic molding or by etching metal or glass. The passage substrate 4 is also formed with nozzles 4*b* and so on extending through the passage substrate 4 in the thickness direction from the internal end of the ink passages 4*a*. As a result, the nozzles 4*b* and the ink passages 4*a* are formed to intersect substantially perpendicularly. The individual ink passages 4*a* are formed midway thereof with pressure chambers 4*c* and so on. In the outer circumference of the ink passages 4*a* and so on, there is formed a generally ring-shaped common ink chamber 4*d* which communicates with the outer end portions of the individual ink passages 4*a*. The passage substrate 4, as shown in FIG. 4, is formed with positioning projections 4*e* and 4*e* which are projected from the outer circumference of the passage substrate 4.

To the face of the passage substrate 4 at the side of the ink passages 4*a*, there is bonded a vibrating plate 5. This vibrating plate 5 is formed with ink supply holes 5*a* facing the ink holes 3*b* of the cartridge case A and communicating with the common ink chamber 4*d* of the passage substrate 4. To the outer face in positions facing the individual pressure chambers 4*c*, there are adhered by an electric conductive adhesive piezoelectric elements acting as ink ejecting means 6 and so on, each of which is formed on its two faces with electrodes 6*a* and 6*b*. In this embodiment, the vibrating plate 5 is made of an electric conductive material such as phosphor bronze so that the individual electrodes 6*b* bonded to the vibrating plates act as common ones.

Between the cartridge case A and the ink jet head B, as shown in FIGS. 1 and 4, there is fixed in a stacked state a flexible cable 7 acting as the electric connecting member C. The flexible cable 7 is formed with the not-shown electric conductive patterns and the common conductive pattern for supplying the electric power to the piezoelectric elements 6 and has its one end portion pressed onto the electrodes 6*a* of the piezoelectric elements 6 and the vibrating plate 5 and its other end portion led out of the cartridge case A. Moreover, the flexible cable 7, as shown in FIG. 4, is formed in its outer circumference with positioning notches 7*a*.

Between the flexible cable 7 and the wall 3 of the cartridge case A, there is sandwiched a pressure rubber 8 acting as an elastic member. This pressure rubber 8 is formed with: recesses 8*a* to be fitted on the pipes 3*c*; and through holes 8*b* to communicate with the ink holes 3*b* thereby to provide the communication between the ink holes 3*b* and the ink supply holes 5*a* and to push the common conductive pattern of the flexible cable 7 onto the vibrating plate 5. The pressure rubber 8 is integrally formed with pressure portions 8*c* for pushing the conductive pattern 7 of the flexible cable 7 onto the electrodes 6*a* of the piezoelectric elements 6.

On the nozzle face side of the passage substrate 4, there is fixed by means of screws a supporting plate 9 which is made of a metal plate. This supporting plate 9 is formed with holes 9*a* facing the nozzles 4*b* and so on.

When the ink jet head block of the present invention is to be assembled, the cartridge case A having the ink 1 housed therein is placed with its head housing portion 3*a* directed upward, and the pressure rubber 8 is stacked by having its recesses 8*a* fitted on the pipes 3*c*. On this pressure rubber 8, there is stacked the flexible cable 7 by positioning it with the positioning notches 7*a*. Next, the ink jet head B is stacked on the flexible cable 7 by positioning it with the positioning projections 4*e*. Finally, the supporting plate 9 is fixed on the cartridge case A by using the not-shown fixing screws. Then, the pressure rubber 8 comes into the pressed state to ensure the electric connections between the piezoelectric elements 6 and the flexible cable 7 and between the vibrating plate 5 and the flexible cable 7. Specifically, the common conductive pattern of the flexible cable 7 comes into abutment against the vibrating plate 5, through which it is electrically connected with the electrodes 6*b* on one face of the piezoelectric elements 6. At the same time, the electric conductive pattern of the flexible cable 7 is held in abutment against the electrodes 6*a* on the other face of the piezoelectric elements 6 by the pressure portions 8*c*. As a result, the electric power can be supplied selectively to the individual piezoelectric elements. Moreover, The communications between the through holes 8*b* and the ink holes 3*b* are attained without any ink leakage. As a result, The ink support holes 5*a* are enabled to communicate with the through holes 8*b* and the ink holes 3*b* so that the ink 1 can be supplied to the common ink chamber 4*d* and ejected through the ink passages 4*a* from the nozzles 4*b*. In this stacked state, the stacking direction, the direction to supply the ink from the cartridge case A to the ink supply holes 5*a* and the direction to inject the ink from the nozzles 4*b* are substantially identical.

Figure 5:
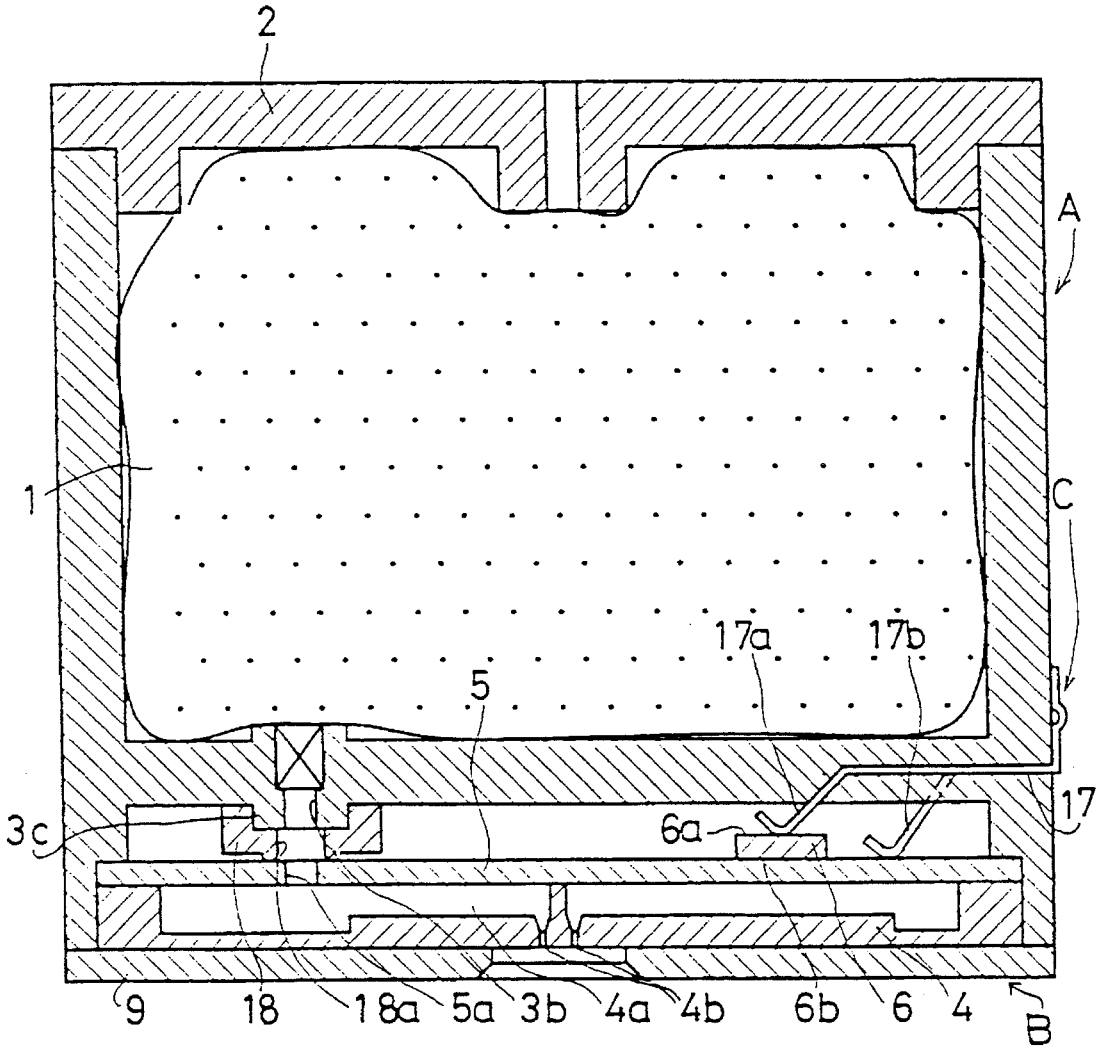
FIG. 5 is a section showing another embodiment of the present invention.

FIG. 5 shows another embodiment, in which the electric connecting member C is made of a metal lead frame 17 in place of the flexible cable. The metal lead frame 17 is molded in the cartridge case A and has its inner end portion equipped with an electric connecting contact members 17*a* elastically contacting with the electrodes 6*a* of the piezoelectric elements 6 and a common contact member 17*b* elastically contacting with the vibrating plate 5 and its outer end portion exposed from the outer circumferential wall of the cartridge case A to the outside. Moreover, the pressure rubber is replaced by packings 18 acting as elastic tic members to be fitted on the pipes 3*c*. These packings 18 are formed input supply holes 18*a* for providing the communications between the ink holes 3*b* and the ink supply holes 5*a*. The remaining construction is similar to that of the foregoing embodiment and has its components designated at the identical reference numerals.

Incidentally, if the passage substrate 4 has a sufficient strength, the ink jet head B may be held under pressure in the cartridge case A without using the supporting plate 9 such that they may be fixed by means of adhesion or ultrasonic bonding.

If the flow direction of the ink from the cartridge case A to the head B is not aligned to the stacking direction of the two, an ink supplying pipe or the like has to be attached from the outside, and the construction cannot be made merely by stacking the individual members. If the head of the aforementioned Prior Art 1 is used, for example, the pipe or the like has to be attached perpendicularly of the thickness direction (or stacking direction) of the head so that the head cannot be made by stacking the individual members simply.

According to the present invention, on the other hand, the ink flow direction from the cartridge case A to the ink jet head B and the stacking direction of the two are substantially aligned. As a result, the ink flow can be retained merely by making the stack such that the ink holes 3*b* of the cartridge case A and the ink supply holes 5*a* of the ink jet head B face each other, so that the manufacture process can be remarkably simplified because no other members need not be disposed outside. In order to prevent the ink leakage, according to the foregoing embodiments, there are sandwiched the elastic members 8 and 18, which may be stacked like the cartridge case A and the ink jet head B so that the manufacture can be simplified.

According to the present invention, as has been described hereinbefore, the cartridge case and the ink jet head are fixed in the stacked state, and this stacking direction, the ink supply direction from the cartridge case to the ink supply holes and the ink ejecting direction from the nozzles are made substantially identical. As a result, the cartridge case and the ink jet head can be bonded merely by stacking the latter on the former, and the ink flow can be retained without using any other members, so that the assembly can be improved and suited for the automation. Moreover, the space can be reduced not only in the two-dimensional direction but also in the thickness direction so that the ink can be fed at the shortest distance without any leakage from the cartridge case to the ink jet head.

Since, moreover, the electric connecting members for supplying the electric power to the ink ejecting means are fixed in the stacked state on the ink jet block, the ink Jet Read can be constructed merely by stacking the individual members sequentially in the same direction so that the assembly is better improve and can be easily automated while simplifying the supply of the electric power.

Moreover, there are provided the elastic members for sealing and providing the communications between the ink holes of the cartridge case and the ink supply holes of the ink jet head, and the elastic members are integrally equipped with the pressure portions for pressing the electric connecting members onto the ink ejecting means. Thus, it is possible to eliminate the ink leakage and to ensure the electric connecting state.

Still moreover, the ink jet head is equipped with the supporting plate on its nozzle face so that the ink passages are not damaged.

What is claimed is:

1. An ink jet head block comprising:

a cartridge case (A) for reserving ink (1) and defining at least one ink hole (3*b*); and an ink jet head (B) stacked on said cartridge case (A), and including:

two plates (4, 5) with surfaces laminated on each other;

ink passages (4*a*) formed radially on the laminated surface of at least one of said two plates (4, 5) and defining inner and outer ends;

at least one common ink chamber (4*d*) formed on the laminated surface of at least one of said two plates (4, 5) and connected to said outer ends of each of said ink passages (4*a*);

at least one ink supply hole (5*a*) perforated on one of said two plates (4, 5), and adapted to be supplied with the ink moved thereto in a first direction from said cartridge case (A) to said at least one common ink chamber (4*d*);

nozzles (4*b*) perforated on another of said two plates (4, 5), and connected to the inner ends of said ink passages (4*a*);

ink ejecting means (6) provided on one of said two plates (4, 5) to correspond to said ink passages (4*a*) for ejecting the ink from said nozzles (4*b*) in a second direction;

said nozzles (4*b*) and said ink passages (4*a*) being formed substantially perpendicular; and an elastic member (8, 18) for sealing and providing communication between said at least one ink hole (3*b*) of said cartridge case (A) and said at least one ink supply hole (5*a*) of said ink jet head (B), said elastic member defining at least one through hole (8*b*, 18), said at least one through hole providing said communication;

wherein said cartridge case (A) and said ink jet head (B) are fixed in a stacked state along a longitudinal axis; and wherein the longitudinal axis of said cartridge case (A) and said ink jet head (B) in said stacked state, the first direction of movement of the ink supplied from said cartridge case (A) to said at least one ink supply hole (5*a*), and the second direction of movement of the ink ejected from said nozzles are substantially identical.

2. An ink jet head block according to claim 1, further comprising an electric connecting member (C) fixed on said ink jet head (B) in a stacked state for supplying electric power to said ink ejecting means (6); and wherein said elastic member is formed integrally with pressure portions for pressing said electric connecting member onto said ink ejecting means.

3. An ink jet head block according to claim 1 further comprising a supporting plate mounted on an outer surface of the other of said two plates of said ink jet head and formed with a hole facing said nozzles.

4. An ink jet head block according to claim 2, further comprising a supporting plate mounted on an outer surface of the other of said two plates of said ink jet head and formed with a hole facing said nozzles.

* * * * *